United States Patent [19]

Sadler

[11] 4,074,527

[45] Feb. 21, 1978

[54] SELF-CONTAINED POWER SUBSYSTEM

[75] Inventor: James E. Sadler, Huntington Beach, Calif.

[73] Assignee: The United States of America as represented by the Secretary of the Air Force, Washington, D.C.

[21] Appl. No.: 675,678

[22] Filed: Apr. 9, 1976

[51] Int. Cl.[2] ..... F15B 15/18

[52] U.S. Cl. ..... 60/325; 60/39.48; 60/632; 91/4 R

[58] Field of Search ..... 91/4 R, 4 A, 5; 60/39.48, 632, 637, 325; 244/3.21; 102/39 R

[56] References Cited

U.S. PATENT DOCUMENTS

| | | | |
|---|---|---|---|
| 2,671,312 | 3/1954 | Roy | 60/39.48 |
| 2,986,005 | 5/1961 | Dudley | 60/632 |
| 3,001,360 | 9/1961 | Budzich | 60/632 |
| 3,097,483 | 7/1963 | Bixson | 60/39.48 |
| 3,100,965 | 8/1963 | Blackburn | 91/4 |
| 3,266,422 | 8/1966 | Matheisel | 244/3.21 |
| 3,276,330 | 10/1966 | Johnson | 91/4 |
| 3,425,217 | 2/1969 | Layendecker | 60/39.48 |
| 3,564,846 | 2/1971 | Moore | 60/39.48 |
| 3,591,967 | 7/1971 | Paine | 60/39.48 |
| 3,595,022 | 7/1971 | Radebold | 60/39.48 |

FOREIGN PATENT DOCUMENTS

| | | | |
|---|---|---|---|
| 594,244 | 3/1960 | Canada | 60/39.48 |

*Primary Examiner*—Martin P. Schwadron
*Assistant Examiner*—Abraham Hershkovitz
*Attorney, Agent, or Firm*—Joseph E. Rusz; Jacob N. Erlich

[57] ABSTRACT

A self-contained power subsystem having at least one actuator module containing at least one actuator, an expulsion tank module connected to the actuator module and a gas generator module connected to the expulsion tank module. A solid propellant within the gas generator module generates a gas, this gas, under pressure, passes into the expulsion tank module where it expels a hydraulic fluid located within the expulsion tank module to a plurality of passageways within the actuator module. Under control of a servo-valve the fluid within the actuator module operates the actuators.

4 Claims, 1 Drawing Figure

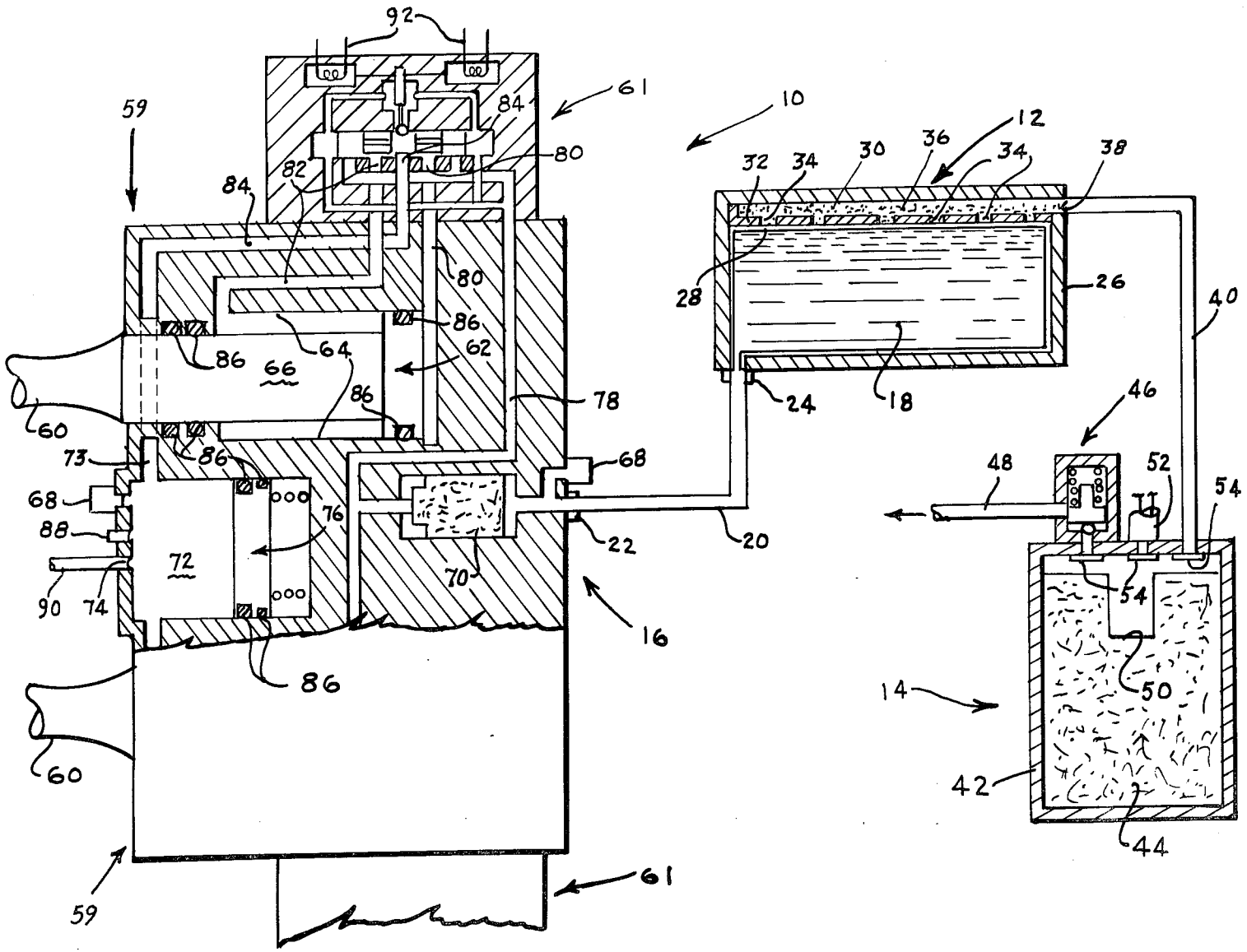
10
12
14
16
18
20
22
24
26
28
30
32
34
36
38
40
42
44
46
48
50
52
54
59
60
61
62
64
66
68
70
72
73
74
76
78
80
82
84
86
88
90
92

SELF-CONTAINED POWER SUBSYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to a self-contained power subsystem, and, more particularly to a self-contained power subsystem for use in missiles and re-entry vehicles and the like and which operates in response to low power level commands.

Many airborne systems such as missiles and re-entry vehicles require subsystems to power control devices in response to low power level commands. These subsystems are normally self-contained since there is usually no external source of power available when the vehicle is airborne. A self-contained power subsystem stores a finite amount of energy until it is needed and then meters the energy to control devices where useful work is performed in response to commands from a separate control subsystem. The energy is stored in a convenient form of chemical, potential or kinetic energy and transformed to the form required by the control devices when it is needed.

The control devices must meet certain performance requirements. These requirements unfortunately place substantial restrictions on the form of the energy required by the control devices. For example, a fast response control device may require energy in the form of a pressurized incompressible fluid to meet certain performance requirements with the current design now in use.

The finite amount of energy that must be stored within the subsystem depends on many factors including the amount of energy that is lost or wasted in obtaining the useful work. The size and weight of the power subsystem depends on the amount and form of the stored energy and the bulk and complexity of the components required to transform the stored energy and control the useful work performed.

In many advanced airborne systems presently in use, severe restrictions are placed on the allowable size and weight of the power subsystem, however, above-average performance is still required. This is particularly true for certain classes of small re-entry vehicles where, in addition, the power subsystem must remain dormant for months or years with no maintenance and then reliably perform a significant amount of useful work over a relatively short period of time (say 30 seconds) responding to commands in a precise manner.

Any self-contained power subsystem basically is a combination of energy storage devices, energy conversion devices, and energy output/control devices. Over the years an almost infinite variety of subsystem concepts have been designed and used in airborne systems with varying degrees of success. The most successful, as a class, are those that store chemical energy using batteries, liquid fuels or solid propellants and convert this energy to controlled mechanical work. All tend to share certain common characteristics:

(1) The stored energy must be converted to another form so that the mechanical work can be precisely controlled, (2) the energy conversion devices tend to be bulky and heavy, and (3) a significant amount of maintenance is required even when the subsystem is dormant.

Significantly, all concepts tend to work equally well for 30 seconds or 30 hours; it is primarily a matter of initially storing more energy for longer periods of operation and performing more maintenance.

What is needed is a subsystem that is extremely small and lightweight, requires no maintenance for long periods of time and, when activated, will reliably perform controlled mechanical work for a relatively short period of time in a precise manner.

SUMMARY OF THE INVENTION

The instant invention sets forth a self-contained power subsystem which overcomes the problems set forth hereinabove.

This invention is designed as an extremely small and lightweight hydraulic power subsystem to reliably perform useful mechanical work in a precise manner over a relatively short period of time after remaining dormant for months or years. For particular applications the subsystem of this invention is extremely efficient and can be effectively used in any application where a small and light system is required and:

1. The operating time is less than approximately 1 minute;
2. The hydraulic fluid consumption is less than approximately 200 cubic inches; and
3. Precise servo-actuator performance is desired.

The self-contained power subsystem of this invention is a combination of actuators, valves, tanks, accumulators, gas generators and miscellaneous components arranged in a novel manner to efficiently store, transform and control energy for operating control devices in response to low power level commands.

The subsystem operates on hydraulic fluid which is stored in an expulsion tank module. During subsystem operation, the fluid within the expulsion tank module is pressurized and expelled by hot, gaseous combustion products from a gas generator module. The gas generator module includes a solid propellant grain enclosed in an insulated shell. Closed combustion of the propellant grain provides the hot gas at an elevated pressure to the expulsion tank module.

The actuator module of the subsystem of this invention includes one or more hydraulic actuators controlled by servo-valves and a manifold containing the other auxiliary components of this invention. The other components are grouped in the manifold to minimize space requirements and eliminate unnecessary fluid connections which may produce fluid leakage. During the dormant period the hydraulic actuators are locked in a fixed position by the use of shear pins or the like.

During operation, the self-contained power subsystem of the instant invention is actuated by an electrical signal to an igniter operatively connected to the gas generator module which generates enough heat to ignite the solid propellant grain therein. At a predetermined elevated pressure the hot gas from the generator module flows into the expulsion tank and forces fluid from the expulsion tank module to the actuator module. A low power level control signal to a servo-valve utilizes the fluid in the actuator module to perform useful work. Fluid from the expulsion tank used by the hydraulic actuators is subsequently dumped overboard. The expulsion tank module of this invention is designed to contain all the fluid required by the actuator during subsystem operation and the fluid contained therein is not recirculated in the system but is dumped overboard. As a result thereof the actuators can be operated for a short period of time after remaining dormant for extended periods of time.

It is therefore an object of this invention to provide a self-contained power subsystem which incorporates therein a combination of components which provide an extremely small and lightweight power subsystem with high performance capabilities.

It is another object of this invention to provide a self-contained power subsystem which has the ability to remain dormant for long periods of time with no maintenance required.

It is a further object of this invention to provide a self-contained power subsystem which utilizes aluminum alloy actuator pistons and housing protected from galling by deposits of anodize.

It is a still further object of this invention to provide a self-contained power subsystem which is economical to produce and which utilizes conventional components in the construction thereof that lend themselves to standard mass producing manufacturing techniques.

For a better understanding of the present invention together with other and further objects thereof reference is now made to the following description taken in connection with the accompanying drawing and its scope will be pointed out in the appended claims.

DESCRIPTION OF THE DRAWING

The only FIGURE of the drawing is a schematic representation, shown partly in cross section, of the self-contained power subsystem of this invention.

DETAILED DESCRIPTION OF THE PREFERRED EMBODIMENT

Reference is now made to the only FIGURE of the drawing which illustrates schematically the self-contained power subsystem 10 of this invention. Subsystem 10 is made up of three basic components; an expulsion tank module 12, a gas generator module 14 and one or more actuator modules 16.

Hydraulic fluid 18 to actuate the subsystem 10 is retained within expulsion tank module 12 and is delivered to each actuator module 16 (one of which being shown in the drawing) through a supply line or tube 20 made of any suitable material such as steel or titanium. Tube 20 is swaged, brazed, or welded to special fitting 22 on actuator module 16 and special fitting 24 on expulsion tank module 12 to prevent fluid leakage. Spacial fitting 22 provides a preloaded metal to metal circumferential seal to prevent the leakage, while fitting 24 involves bimetal welds to prevent gas and fluid leakage.

Expulsion tank 12 is formed of an outer shell 26 constructed from any suitable material such as a titanium alloy capable of withstanding high pressure. Located within shell 26 is an aluminum bladder 28 which completely separates combustion products or hot gases 30 from the hydraulic fluid 18.

A distribution plate 32 having a plurality of openings 34 therein receives the hot gases 30 and controls its velocity to prevent hot spots on bladder 28. Distribution plate 32 also pre-creases bladder 28 when the expulsion tank module 12 is assembled in order to control the geometry of bladder 28 when it collapses as fluid 18 is expelled through tube 20 during subsystem operation. The geometry is controlled to prevent failure of bladder 28 and allow more than 95 per cent of fluid 18 to be expelled with less than 50 psig loss in pressure. In addition hydraulic fluid wetting the soft aluminum bladder 28 acts as a heat sink and controls the temperature of bladder 28 during operation of subsystem 10.

The titanium alloy shell 26 and distribution plate 32 are not insulated; the mass of both acting as heat sinks to control their temperatures during subsystem operation. When expulsion tank module 12 is assembled, the plenum area 36 behind distribution plate 32 is evacuated to a pressure of about $10^{-6}$ torr and sealed with a welded-in burst disk 38 to finalize the form of bladder 28 in shell 26. This supports bladder 26 prior to subsystem operation and prevents vibration-induced fatigue failures.

Hot gas 30 is delivered to expulsion tank module 12 from the gas generator module 14 through any suitable tube 40 such as an uninsulated Columbiam alloy tube bolted, to each with metallic face seals (not shown). The Columbiam alloy tube 40 is designed to provide sufficient strength to transport 1800° F gas at 3800 psig to expulsion tank module 12 for at least 30 seconds of subsystem operation.

Gas generator module 14 includes an insulated outer shell 42 of any suitable material such as a titantum alloy. Shell 42 encloses therein a solid propellant grain 44 made of a finely divided oxidizer dispersed in any suitable fuel matrix such as ammonium nitrate or ammonium perchlorate. Closed combustion of the propellant grain 44 provides the hot gas 30 at a pressure of 3800 psig. The gas pressure is controlled by a pressure relief valve 46 bolted to gas generator module shell 42. Hot gas generated in excess of that required to expel fluid 18 in tank module 12 is dumped overboard through pressure relief valve 46 via alloy steel tube 48 welded to relief valve 46.

The burn area of the propellant grain 44 is shaped with an indented central portion 50 to provide extra gas flow during the first few seconds of subsystem operation to maintain the required gas pressure while the metallic components in the system are warming up. Gas generator module 14 is fired electrically by any conventional igniter 52. Vapor barriers 54 which quickly burn away are provided to protect propellant grain 44 during the long dormant period before subsystem 10 is activated.

Any number of actuator modules 16 are attached to tube 20 (for simplicity only one such actuator module 16 is shown in the drawing). Each actuator module 16 includes at least one manifold 59, an associated hydraulic actuator 60 and a conventional servo-valve 61. Although two manifolds 59, actuators 60, and servo-valves 61 are shown in the drawing, only one manifold 59, actuator 60 and valve 61 will be described in detail hereinbelow since the elements associated therewith are identical for all corresponding manifolds and actuators.

In this invention the actuator module 16, manifold 59 and actuator piston 62 are made of an aluminum alloy to minimize weight and vulnerability to nuclear radiation. The surfaces of the cylinder bore 64 and the piston rod 66 are protected by deposits of hard anodize to minimze friction and prevent galling when the actuator 60 is operated under loads. The life of the anodized parts is limited but sufficient for certain applications. This is believed to be a novel application of materials and processes to obtain acceptable performance at minimum weight.

In addition manifold 59 includes self-sealing fluid quick disconnects 68, an optional fluid filter 70, a fluid plenum 72, and a burst disk 74. The fluid quick disconnects 68 are used to service and vacuum fill the otherwise sealed fluid system within manifold 59, tube 20 and enpulsion tank module 12 and to operate the servo-controlled actuators 60 during ground testing using an external fluid power supply. Redundant seals are used on the quick disconnects to minimize fluid leakage during the dormant period prior to subsystem operation. During this dormant period, the fluid system is sealed and maintained at a low pressure (5–25 psig) to seat external seals and minimize external leakage of the fluid. The pressure is provided by a spring-loaded piston 76 in fluid plenum 72 which maintains the pressure as the fluid expands and contracts during temperature variations. When the fluid system is initially filled, the fluid level in plenum 72 is adjusted using a sight gage (not shown) in piston 76 calibrated directly in terms of fluid temperature.

Manifold 59 further includes line 78 which carries fluid 18 from filter 70 to conventional servo-valve 61 and by means of lines 80 and 82, in accordance with the operation of valve 61, to piston chamber or bore 64. All used fluid 18 is removed from the system by line 84 in a manner to be described in detail hereinbelow.

During the dormant period, actuator pistons 60 are locked in a fixed position by conventional shear pins or the equivalent (not shown) to fix the volume of the fluid within subsystem 10. Redundant seals 86 are used on the actuator piston 62 and the plenum piston 76. A standard high pressure o-ring seal is used in combination with a special low pressure seal to minimize leakage and protect the fluid from atmospheric attack. The status of the fluid system is monitored with a pressure switch 88 that senses system pressure during the dormant period. Fluid leakage will deplete the plenum 72 and allow the spring-loaded piston 76 to bottom out. When this occurs, the system pressure will drop below $3 \pm 1$ psig, closing pressure switch 88 and activating an electrical circuit (not shown) indicating low fluid level.

In operation the self-contained power subsystem 10 of this invention is activated by an electrical signal to igniter 52 on gas generator module 14. Igniter 52 generates enough heat to ignite the solid propellant grain 44 within shell 42. The hot gas generated burns away vapor barriers 54 in shell 42 and pressurizes the hot gas duct 40. When the gas pressure reaches $2700 \pm 500$ psig, the burst disk 38 in expulsion tank module 12 opens allowing the hot gas 30 to flow into plenum 36 and pressurize the fluid 18 contained within bladder 28. When the gas pressure reaches about 3800 psig, the pressure relief valve 46 on generator module 14 opens to vent excess gas overboard and maintain a gas pressure of $3800 \pm 200$ psig.

Pressurized fluid 18 is forced from the expulsion tank module 12 and delivered to the actuator module 16 by fluid line 20. During operation, normal leakage flow through servo-valve 61 gradually fills plenum 72 by way of line 84 through line 73 until the spring-loaded piston 76 bottoms. When the pressure in plenum 72 builds up to $150 \pm 50$ psig, the burst disk 74 on actuator module 16 opens allowing the fluid 18 used by the servo-actuators 60 to subsequently be dumped overboard through an overboard dump line 90. After burst disk 74 opens the fluid in plenum 72 drops to approximately atmospheric pressure and the spring-loaded piston 76 moves to the fully extended position adjacent line 73 where it remains during the remaining operation of subsystem 10.

Low power level control signal coils 92 within servo-valve 61 port fluid 18 by means of either lines 80 or 82 in a conventional manner to move piston 62 within cylinder bore 64 thereby motivating actuator 60.

The first time the actuator 60 is commanded to move, the shear pin, or equivalent breaks when the differential pressure between lines 80 and 82 reaches about 800 psig allowing subsequent controlled movement of piston 62. Fluid 18 is delivered by lines 80 and 82 to cylinder bore 64 to move piston 62 in either the extending retracting direction. The fluid 18 which has been used within actuator module 16 is then returned to servo-valve 61 and rerouted by lines 84 and 74, to plenum chamber 72 and dumped overboard through outlet line 90. The expulsion tank module 12 of this invention is designed to contain all the fluid 18 required by actuator module 16 during subsystem operation; the fluid 18 in this invention is not recirculated in the system 10 but removed or dumped overboard after use thereof. As a result thereof this invention provides an efficient closed subsystem capable of operation for a predetermined short period of time after an extremely long period of system inactivity.

I claim:

1. A self-contained, complete power subsystem comprising at least one actuator, an actuator module operatively connected to said actuator, hydraulic source means connected to said actuator module for providing an operative hydraulic fluid to said actuator module, and means connected to said hydraulic source means for providing motive force to said hydraulic fluid, said actuator module comprising at least one manifold, said manifold having a plurality of fluid passageways therein, said passageways being connected to said hydraulic source means, a fluid plenum, a piston located within said plenum, said passageways being connected to said plenum and said plenum being connected by a rupturable seal to the atmosphere in order to release to the atmosphere said hydraulic fluid which has been used within said subsystem, and a servo-valve, said servo-valve being connected to said passageways, weaus for actuating to direct said servo-valve said hydraulic fluid within said passageway in a preselected manner thereby causing the operation of said actuator, whereby upon actuation of said means for providing motive force to said hydraulic fluid, said hydraulic fluid is directed to said actuator module thereby providing controlled operation of said actuator for the predetermined period of time in which hydraulic fluid is available prior to release of said operative hydraulic fluid to the atmosphere.

2. A self-contained power subsystem as defined in claim 1 wherein said hydraulic source means is in the form of an expulsion tank module, said expulsion tank module having a shell, said shell containing said operative hydraulic fluid therein, means operatively connecting said fluid to said passageways in said manifold, a bladder separating said operative hydraulic fluid from a gas received under pressure from said motive force providing means and a distribution plate located adjacent said bladder for controlling the geometry of said bladder.

3. A self-contained power subsystem as defined in claim 2 wherein said means for providing a motive force to said operative hydraulic fluid is in the form of a gas generator module, said gas generator module comprising an insulated shell, said shell containing a solid propellant grain therein and an igniter operatively associated with said solid propellant grain whereby upon actuation of said igniter, combustion of said propellant grain takes place producing said gas under pressure utilized in said expulsion tank module.

4. A self-contained power subsystem as defined in claim 1 wherein said manifold further comprises a bore operatively connected to said passageways and a piston rod slideably mounted within said bore, said piston rod being connected to said actuator.

* * * * *